US005689889A

United States Patent [19]

Overholt

[11] Patent Number: 5,689,889

[45] Date of Patent: Nov. 25, 1997

[54] KNIFE WITH REPLACEABLE CUTTING ELEMENT

[76] Inventor: Steven D. Overholt, 4275 D. J. Dr., Missoula, Mont. 59803

[21] Appl. No.: 697,615

[22] Filed: Aug. 28, 1996

[51] Int. Cl.[6] ..... B26B 5/00

[52] U.S. Cl. ..... 30/332; 30/329

[58] Field of Search ..... 30/329, 332, 340, 30/342, 344

[56] References Cited

U.S. PATENT DOCUMENTS

| | | | |
|---|---|---|---|
| 891,238 | 6/1908 | Feinenburg | 30/349 |
| 1,110,181 | 9/1914 | Bitz | 30/349 |
| 1,332,256 | 3/1920 | Hart | 30/342 |
| 1,426,184 | 8/1922 | Hammar | 30/348 |
| 1,851,829 | 3/1932 | Gonyk | 30/349 |
| 1,888,488 | 11/1932 | Brown . | |
| 2,610,401 | 9/1952 | Vosbikian et al. | 30/332 |
| 2,647,314 | 8/1953 | Gilson | 30/349 |
| 3,107,426 | 10/1963 | Robinson, Jr. | 30/162 |
| 3,772,955 | 11/1973 | Pearl | 83/746 |
| 3,986,260 | 10/1976 | Whiteford | 30/296 A |
| 4,180,909 | 1/1980 | Lind | 30/332 |
| 4,574,673 | 3/1986 | Pearl | 83/697 |
| 4,712,364 | 12/1987 | Oxley | 56/295 |
| 4,890,388 | 1/1990 | Rose | 30/260 |
| 5,027,516 | 7/1991 | Howerton | 30/329 |

FOREIGN PATENT DOCUMENTS

| | | | |
|---|---|---|---|
| 27 18 638 | 11/1978 | Germany | 30/332 |

*Primary Examiner*—Hwei-Siu Payer
*Attorney, Agent, or Firm*—Harry M. Cross, Jr.

[57] ABSTRACT

A knife having a handle section and a blade section, the blade section comprising a pair of opposed flanking side members and a replaceable blade insert confined between the side members and held therebetween. The side members are joined together by a blade insert locator so as to provide a slot for the blade insert. The blade insert is configured to engage with the blade insert locator so as to be held in place in the slot. The blade insert includes a tang configured to extend into the handle section, and the handle section is configured to receive the tang and to confine the tang within the handle section. The handle section includes a tang spacer positioned to separate the side members within the handle section so that the tang fits within the handle section between the side members.

14 Claims, 5 Drawing Sheets

10
12
14
16
18
18a
20
20a
22
22a
22b
24
24a
26
26a
26b
30
32a
32b
34
36
38
40
42
44
46

7
7
18
19
20
26
26a
26b
48
50
52
54
56
14
16

18
22
26
22b
32a
32b
30

KNIFE WITH REPLACEABLE CUTTING ELEMENT

BACKGROUND OF THE INVENTION

1. Field of the Invention

This invention relates to knives and, more particularly, to knives having replaceable cutting blades.

2. Brief Description of the Prior Art

Fixed-blade knives are commonly fabricated in the form of a cutting blade that extends from within a fixed handle to a cutting projection wherein the cutting blade has an integral tang that extends into and is secured within the handle. Often, the handle grip is comprised of two side halves that are fastened to either side of the tang so that the handle is a composite of the centrally-disposed tang flanked by the two handle side grip halves. The cutting projection, as an integral projection of the tang, typically comprises an elongated metal member that has a sharpened elongated cutting edge that projects from the handle along one edge of the projection to the tip of the projection. Typical of such knife configurations are hunting knives, kitchen knives and the like. A common characteristic of such knives is that the cutting projection has a substantial thickness so as to impart sufficient stiffness to the sharpened cutting edge. The projecting member is commonly thicker at the handle and progressively thinner toward the tip.

These knives must be periodically resharpened. Under some conditions, such as when out in the field, it is inconvenient or impossible to resharpen the cutting edge at the time most needed. It is often the case, furthermore, that the person using the knife either does not know how to sharpen a knife cutting edge properly or does not have sharpening implements at hand.

SUMMARY OF THE INVENTION

A primary object of the present invention is to provide a fixed handle knife with a blade projection that incorporates an elongated replaceable cutting element. Another object of the present invention is to provide such a knife where the replaceable cutting element is detachably secured to the elongated side supports that extend alongside and flank the cutting element. A further object of the present invention is to provide such a replaceable cutting element where the element is also detachably secured within the fixed handle. Still another object is to provide such a composite knife blade configuration where the elongated replaceable cutting element is installed and removed by insertion and retraction between the flanking side supports.

These objects and advantages will become apparent from the following description of the invention.

In accordance with these objects and advantages, the invention comprises a knife having a handle section and a blade section, the blade section comprising a pair of opposed flanking side members and a replaceable blade insert confined between the side members and held therebetween. The side members are joined together by a blade insert locator so as to provide a slot for the blade insert. The blade insert is configured to engage with the blade insert locator so as to be held in place in the slot. The blade insert includes a tang configured to extend into the handle section, and the handle section is configured to receive the tang and to confine the tang within the handle section. The handle section includes a tang spacer positioned to separate the side members within the handle section so that the tang fits within the handle section between the side members.

BRIEF DESCRIPTION OF THE DRAWINGS

FIG. 30 is a cross-section view taken along the line 30—30 of FIG. 1.

DESCRIPTION OF THE PREFERRED EMBODIMENT

Figures 1, 2, 3, 3A, 3B, 3C, 4, 5:
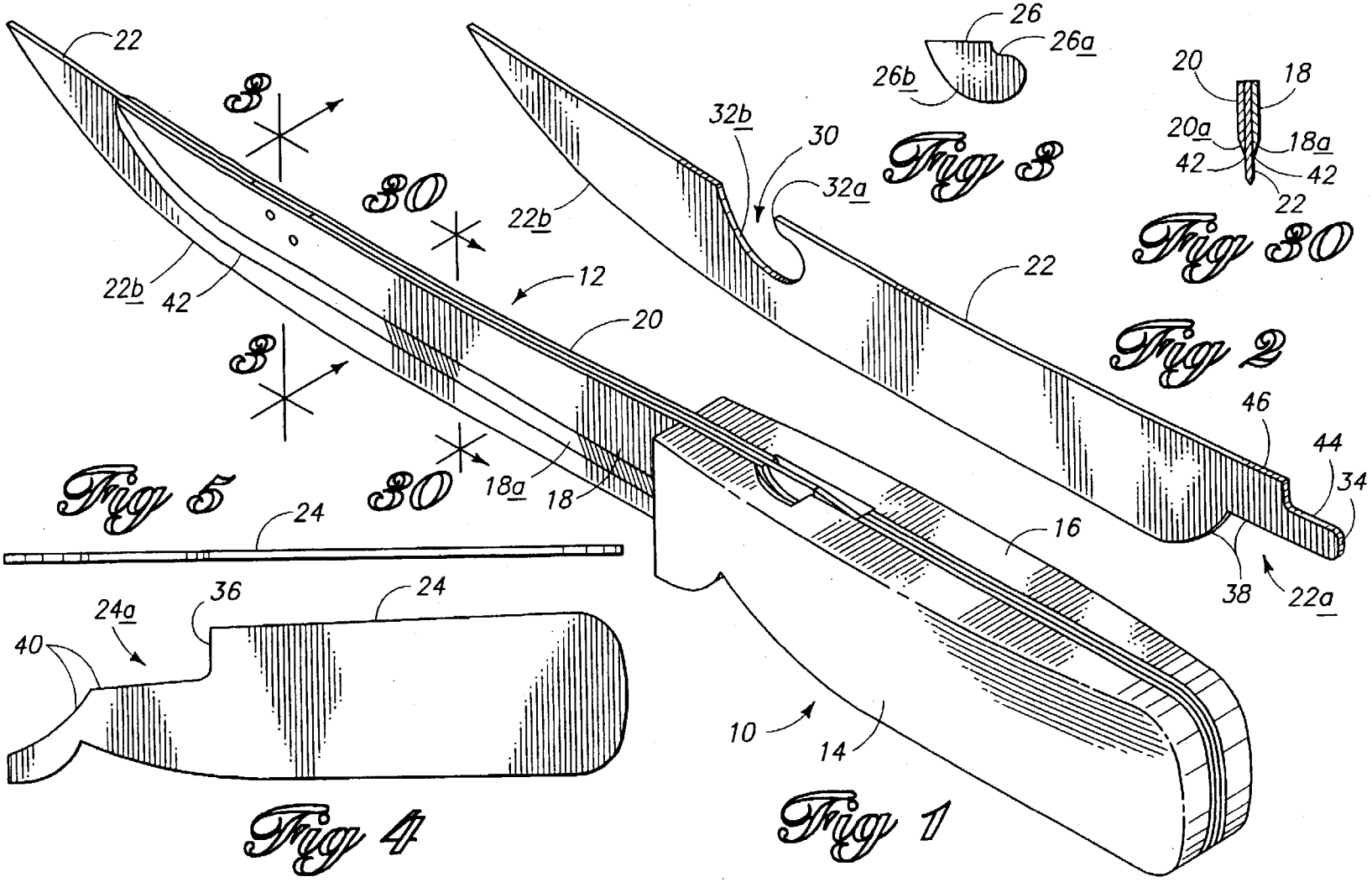
FIG. 1 is a perspective view of the fixed-blade knife of this invention.
FIG. 2 is a perspective view of the elongated replaceable cutting element portion of the FIG. 1 knife.
FIG. 3 is a detail view taken along the line 3—3 in FIG. 1 illustrating the blade projection attachment for the FIG. 2 element.
FIG. 4 is a side elevation view of a handle insert spacer contained within the handle of the FIG. 1 knife.
FIG. 5 is a top view of the FIG. 4 spacer.

The fixed-blade knife of this invention comprises a handle section 10 and a blade section 12. The cutting blade section 12 has a first portion that projects from the handle and contains the knife cutting edge, and a second portion that is contained within the handle section. The handle section includes two flanking side grips 14, 16 that confine the tang portion of the blade section 12. Although at a first glance of FIG. 1, the knife might appear as of common construction, the cutting blade section 12 is distinctly different. The cutting blade section is composed of three members, two side support members 18, 20 that flank an intermediate blade insert 22. The blade insert 22 and the flanking side support members are constructed so that the projecting portion of the blade insert is confined and held between the flanking side support members. The blade insert 22, the flanking side support members 18, 20, and the handle grips 14, 16 are constructed so that a rear portion of the blade insert is confined and held within the handle. As a consequence of this construction, the blade insert 22 is supported at two locations: one in the first portion of the blade that projects from the handle; and one in the second portion of the blade that is contained within the handle.

The tang sections of the flanking side support members 18, 20 are confined between the handle grips 14 and 16 and separated by a tang spacer member 24. The tang spacer 24 has a thickness equal to the thickness of the blade insert 22. The flanking side support members 18, 20, the tang spacer 24, and the grips 14, 16 are attached to one another, as by being bonded by an adhesive or cement, or by being mechanically attached by rivets or the like, so as to form in their composite the handle section 10. The tang spacer is also formed at its forward end to provide a seating section **24*a* for the rear end of the blade insert 22**.

The projecting section of the flanking side support members 18, 20 are separated from one another by a blade insert locator member 26. Locator 26 has a thickness equal to the thickness of the blade insert 22. The flanking side support members 18, 20 and the locator 26 are attached to one another as by being mechanically attached by rivets or the like, or welded together. The rear end of the locator 26 is formed to provide a locating and locking edge **26*a*, and the underside of the locator 26 is formed to provide a blade insert seating edge 26*b*. The locator 26 may be positioned at a distance about ⅔ of the length of the side support members 18, 20 from the handle section 10. The locator 26 is positioned between the side members 18,20** so that its top edge is flush with the top edges of the side members.

Figures 13, 14, 15, 16, 17:
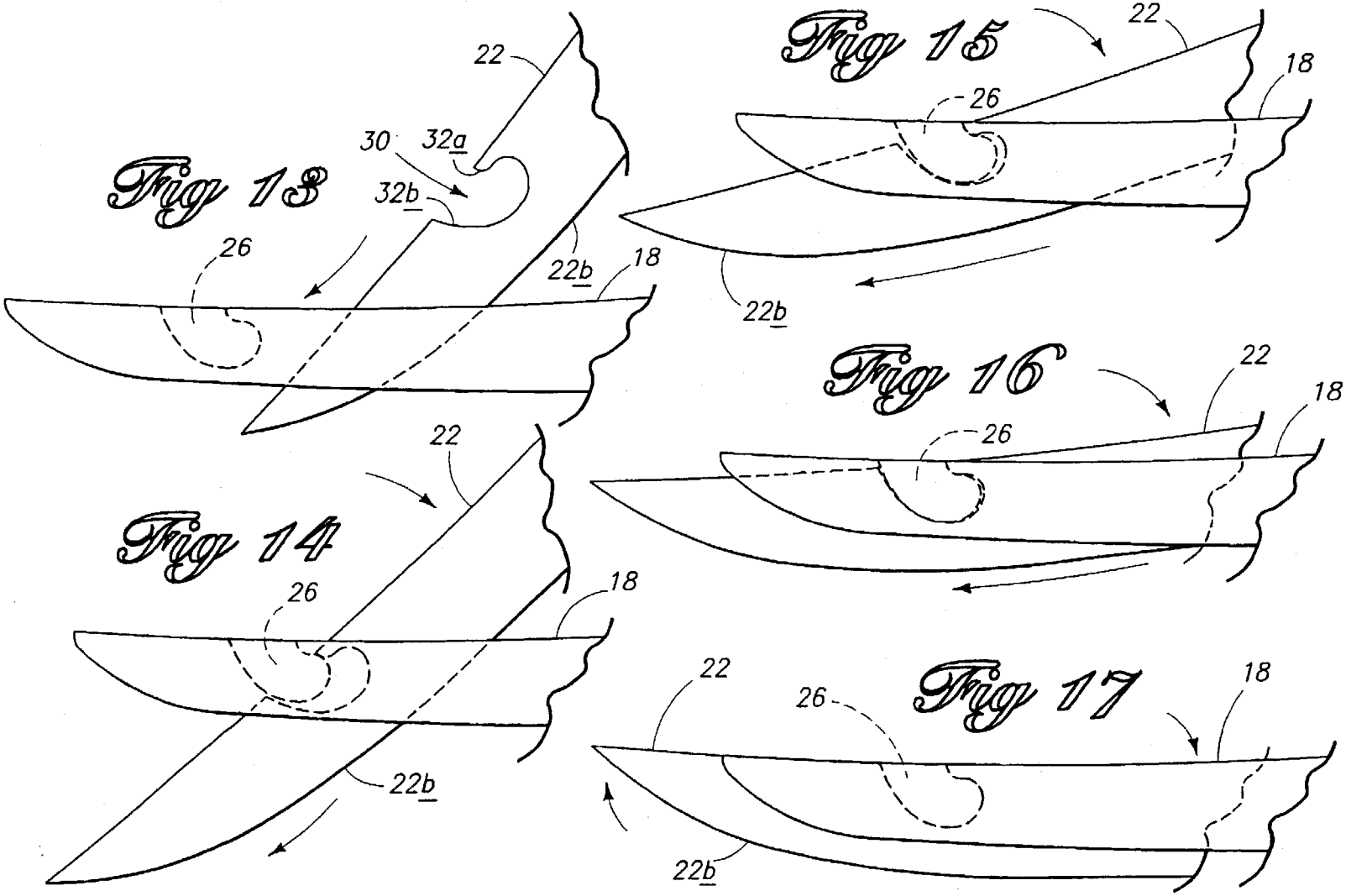
FIGS. 13–17 are partial side elevation views of the tip portion of the FIG. 1 knife illustrating in sequence the insertion of the replaceable cutting element between the flanking side support members.
Figure 19:
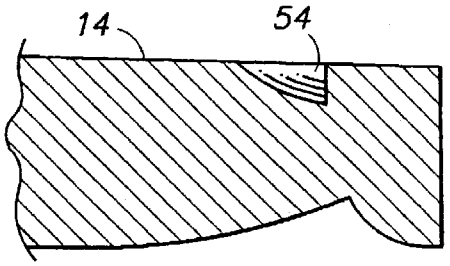
FIG. 19 is a partial view in cross section taken along the line 19—in FIG. 11.
Figure 18:
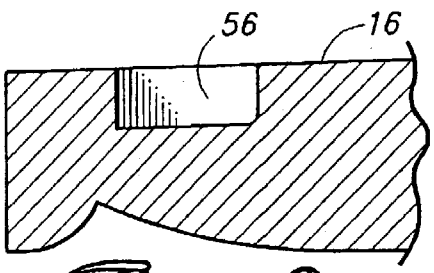
FIG. 18 is a partial view in cross section taken along the line 18—in FIG. 10.

The blade insert 22 is provided with a cutout 30 shaped so that it has a forwardly-pointing rear projection **32*a* and a bottom edge 32*b*. Projection 32*a* is shaped to mate with the locator locking edge 26*a*, and bottom edge 32*b* is shaped to mate with the locator blade seating edge 26*b*, respectively. As a consequence of the matching configurations of projection 32*a* with locking edge 26*a*, and of bottom edge 32*b* with blade seating edge 26*b*, the blade insert 22 may be placed between the flanking side support members 18, 20, and the cutout 30 engaged with the locator 26 to both locate the blade insert 22 in its proper location as well as lock the blade insert 22 to the projecting portion of the blade 12. FIGS. 13–17 illustrate, in sequence, the placement of the blade insert 22 between the flanking side members 18, 20 and locking the blade insert 22 to the locator 26. As the blade insert 22 is placed between the flanking side members 18, 20, tip first, the cutout projection 32*a* is engaged with the locking edge 26*a* so that the blade insert 22 may be pivoted around the locator 26 until the blade insert is fully aligned with the side members. When the blade insert 22 is fully aligned with the flanking side members 18, 20, the top edge of the blade insert will be flush with the top edges of the side members as shown in FIGS. 17 and 1, and the edge of the cutout 30 will completely abut the edge of the locator 26 as shown in FIG. 17. Removing the blade insert 22 can be achieved by reversing the sequence of the procedure shown in FIGS. 13–17**.

When the blade insert 22 is fully engaged with the locator 26, as shown in FIG. 17, the blade insert is locked into its relationship with the flanking side support members 18, 20 and the locator 26 against upwardly, downwardly and forwardly directed forces. When fully engaged with the locator 26 as shown in FIG. 17, the blade insert 22 is locked against rearwardly and downwardly directed forces as a result of the mating of the rear end of the blade insert with the seating section **24*a* of the tang spacer 24. The rear seating section 22*a* of the blade insert 22 and the upper edge of the seating section 24*a* are formed so that rear seating section 22*a* will seat down and against the seating section 24*a* when the blade insert 22 is placed in its operative position as seen in FIGS. 1 and 17. The rear seating section 22*a* is formed to provide a substantially vertical back edge 34 that mates with a substantially vertical back edge 36 of seating section 24*a*, and a forwardly-extending bottom edge 38 that mates with a forwardly-extending top edge 40 of seating section 24*a*. The abutment of the edges 34 and 36 prevent rearward movement of the blade insert 22. The abutment of edges 38 and 40 prevent downward movement of the rear portion of the blade insert 22**.

Figures 6, 7, 8, 9, 10, 11, 12:
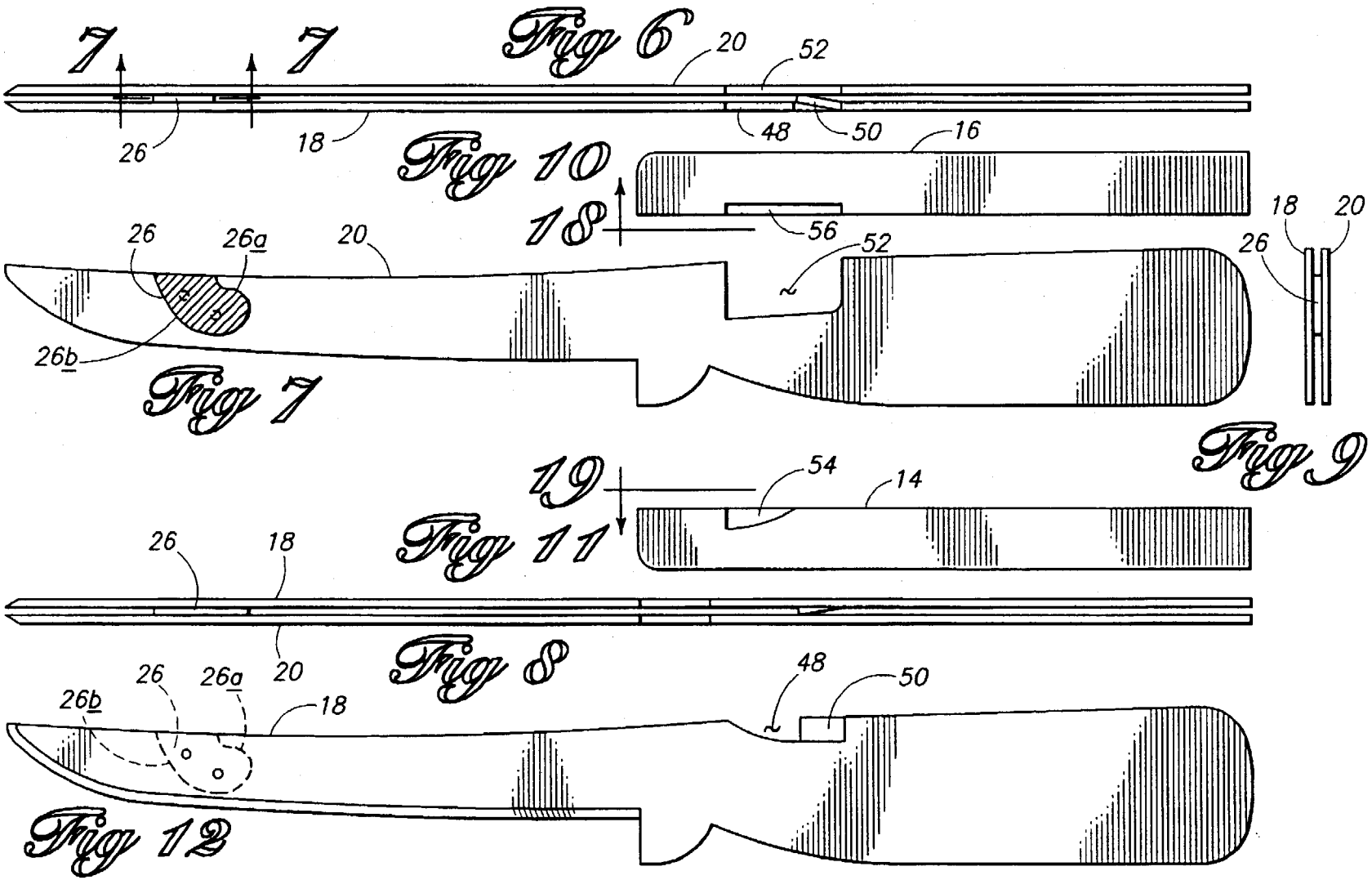
FIG. 6 is a top view of the elongated flanking cutting element side support members for the FIG. 1 knife.
FIG. 7 is a side elevation view of one of the flanking side support members that includes a sectional view taken along the line 7—7 in FIG. 6.
FIG. 8 is a bottom view of the FIG. 6 assembly.
FIG. 9 is a rear end elevation view of the FIG. 6 assembly.
FIG. 10 is a top view of one of the handle side halves of the FIG. 1 knife.
FIG. 11 is a top view of the other handle side half of the FIG. 1 knife.
FIG. 12 is a side elevation view of the other flanking side support member.

The flanking side members 18, 20 may be fabricated of a durable, reasonably stiff metal, such as tungsten carbide or stainless steel. Alternately, they may be fabricated from cast steel or bronze, or a suitable engineering plastics material such as fiber glass-filled, or graphite—filled, nylon or polyurethane, and they may be reinforced with graphite fiber laid along the length of the side members. They are shaped in their tang section to conform to the peripheral outline of the handle section 10 as seen in FIGS. 7 and 12. They are shaped in their projecting blade section to have a peripheral outline similar in pattern to the blade insert 22, except that the depth of the side members 18, 20 is sufficiently less than the depth of the blade insert 22 that the blade insert's cutting edge **22*b* is adequately exposed. The inner surfaces of the side members 18, 20 are parallel and coplaner with the outer surfaces of the blade insert 22 so that the portion of the blade insert that is confined between the side members will abut and be supported by the side member inner surfaces. The outer surface of the projecting portion of each side member, 18, 20, is shaped to taper, as seen at 18*a*, 20*a* in FIG. 30, to a very narrow lower edge, as at 42 in FIGS. 1 and 30, so that the transition from the blade insert 22 to the outer surface of each side member is streamlined. To the touch, the lower edges 42 of the side members would feel sharpened and the transition from the blade insert to each side member would be relatively imperceptible. The tips of the side members would likewise be tapered to the fine edge 42 as seen in FIG. 1. The relative thickness of the blade insert 22 and of the tang spacer 24 and blade insert locator 26 are such that the blade insert 22 is confined between the flanking side members 18, 20 in a very close fit. Consequently, the conformation of the outer surface of each side member, leading to the narrow lower edge 42**, will provide smooth transitions between the blade insert and the side members so that the composite knife blade of this invention will function as well as a single blade.

The blade insert 22 is preferably fabricated of a metal that retains a sharp edge, such as material from which razor blades are formed. The side surfaces of the blade insert 22 are parallel and coplaner. The blade insert 22 is formed as a thin strip of such material that has a sharpened edge 22b applied after it has been formed. The sharpened edge 22b can be formed in any desired configuration, such as V-shaped, serrated, beveled to provide a single cutting taper, and the like. The sharpened edge may be honed with a sharpening steel without substantially changing the edge bevel. When the blade insert 22 becomes excessively worn, due to resharpening, it may be removed and replaced. Of course, a dull blade insert may be removed and replaced regardless of whether it has ever been resharpened.

Figure 22:
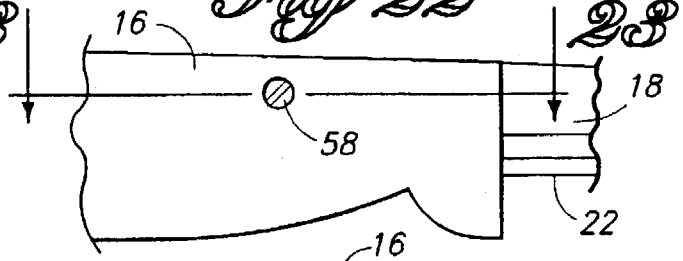
FIG. 22 is a partial side elevation view of a knife handle illustrating an alternative handle lock for locking the replaceable cutting element into the handle.
Figure 23:
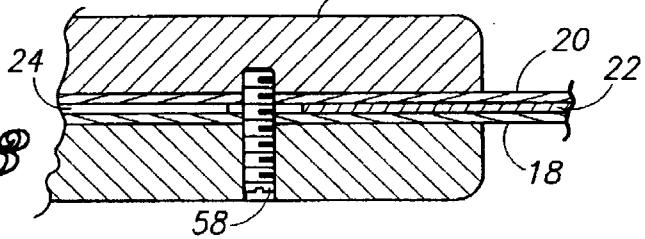
FIG. 23 is cross section detail view taken along the line 23—23 in FIG. 22.

The handle section 10 is designed to secure the blade insert 22 in its operative position, the position shown in FIGS. 1 and 17. In general, the handle section 10 may be provided with separate locking means to hold the rear end of the blade insert in the handle section, or the blade insert and the tang sections of the side members 18, 20 may be constructed to provide integral locking means to hold the blade insert into the handle section. To provide separate locking means, an element or elements must be added to the handle section 10 to provide for holding the blade insert in the handle section, such as a side screw, ball detent, clasp, slide or pinned lever designed to engage the rear end of the blade insert. To provide integral locking means, no additional element is required. FIGS. 22–23 illustrate one version of the knife 10 handle section 10 providing separate locking means, FIGS. 24–28 illustrate another version providing separate locking means, and FIGS. 1–2, 10–12 and 18–21 illustrate one version providing integral locking means.

Figure 20:
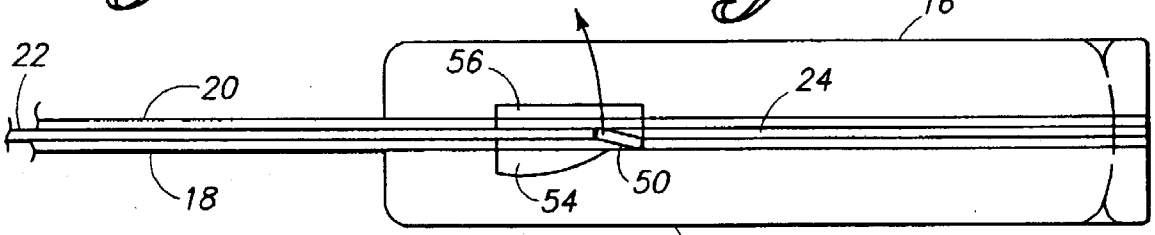
FIG. 20 is a top view of the handle end of the FIG. 1 knife with the replaceable cutting element locked into the handle.
Figure 21:
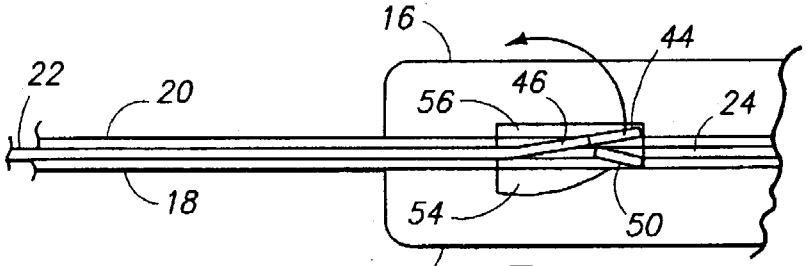
FIG. 21 is a partial top view of the handle end of the FIG. 1 knife with the replaceable cutting element unlocked from the handle.

With specific reference to FIGS. 1–2, 10–12 and 18–21, the rear end section of the blade insert 22 may be provided with a locking edge 44 and a disengaging edge 46. One of the side members 18 is notched out at 48 (FIG. 12) to provide a thumb recess and is provided with a tab 50 that is bent into the plane of the blade insert 22. Tab 50 is positioned to overlay the blade insert locking edge 44 when the blade insert is in its operating position as seen in FIG. 1 and 20. The other side member 20 is notched out at 52 (FIG. 7) to provide a gap through which the blade insert edges 44, 46 may be moved to unlock the blade insert from the handle section 10. By pressing laterally against edge 46, edge 44 can be shifted over, from beneath tab 50, so as to free the rear end of the blade insert as seen in FIG. 21. The grip 14, adjacent side member 18, is provided with a thumb recess 54 to expose the blade insert disengaging edge 46. The other grip 16 is provided with a recess 56 to provide a space within which locking edge 44 may be shifted to release it from beneath tab 50. For this feature to be functional, the blade insert 22 must be fabricated from material that is sufficiently flexible that the blade insert edge 44 can be bent as shown in FIG. 21 without exceeding the elastic limit of the material.

When the blade insert 22 has cleared the tab 50, the cutting edge 22b, at a location rearward of locator 26, may be pressed downwardly against an immovable object so as to cause the blade insert's rear end section to pivot upward and out of confinement by the handle section 10. When the rear end section has been pivoted out of the handle section 10, it may be gripped and pulled upward to remove the blade insert 22 from knife.

With specific reference to FIGS. 22 and 23, a set screw 58 may be threaded through one of the grips 16 and through suitable apertures provided in the near side member 20 and the blade insert's rear end section so as to secure the blade insert rear end section within the handle section 10. Alternately, a roll pin or similar shaft element could be extended completely through both grips 14, 16 and both side members 18, 20 to secure the blade insert within the handle section 10. Also, alternately, a sliding plate (not shown) could be mounted into the top of the handle section 10 so as to overlay the blade insert's rear end section so that the plate could be shifted between an overlaying (locking) position and a non-overlayed (unlocked) position. Such a sliding plate could be designed as a flat element to slide laterally forward and rearward. Or the sliding plate could be designed as a slotted sleeve to turn about a longitudinal axis so as to expose the sleeve's slot to the blade insert for disengagement of the blade insert, or to cover the blade insert to lock the blade insert into the handle section.

Figures 24, 25, 26, 27, 28, 29:
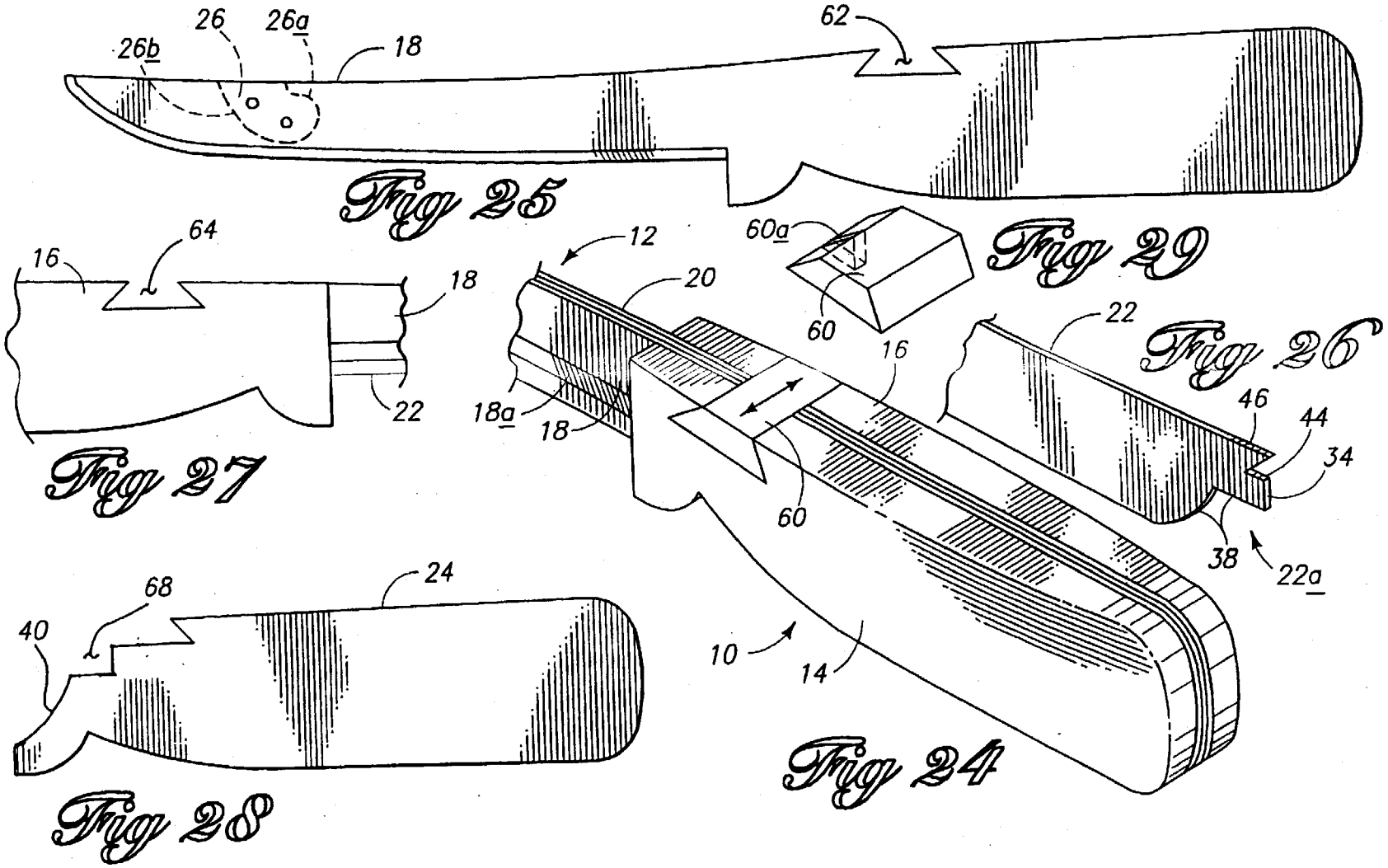
FIG. 24 is a partial perspective view of the fixed-blade knife of this invention illustrating another alternative handle lock for locking the replaceable cutting element into the handle.
FIG. 25 is a side elevation view of one of the flanking side support members of the FIG. 24 embodiment.
FIG. 26 is a perspective view of the blade insert tang of the FIG. 24 embodiment.
FIG. 27 is a partial side elevation view of a knife handle illustrating provision for the alternative handle lock of the FIG. 24 embodiment.
FIG. 28 is a side elevation view of a handle insert spacer contained with the handle of the FIG. 24 embodiment.
FIG. 29 is a perspective view of the slide of the FIG. 24 embodiment.

With specific reference to FIGS. 24–28, the handle 10 may be provided with a slide 60 fitted into appropriately configured notches 62, 64 and 68. The flanking side support members 18, 20 are appropriately notched, as at 62, and the handle flanking grips 14, 16 are appropriately notched at 64. The slide 60 is formed to provide beveled transverse front and rear sides to conform with the similarly configured notches 62, 64. Together, the notches 62, 64 provide a transverse slide slot having the configuration of a trapezoid having parallel top and bottom bases and front and rear non-parallel sides aligned so that the top base is narrower than the bottom base. In the FIG. 24 embodiment, as in the FIG. 1 embodiment, the handle section may also include a tang spacer 24 and, if so, it is provided with an appropriate notch 68 in its top edge 40 to complete the transverse slide slot. The rear edge 44 of the blade insert 22 is likewise preceded by an appropriate notch as seen in FIG. 26. The slide 60 may be shifted to one side or the other so as to expose the blade insert locking edge 44 so that the blade insert 22 may be dislodged and removed from the handle section 10, as heretofore described with reference to the FIG. 1 embodiment. Likewise, the slide 60 may be shifted to one side to expose the slide slot sufficiently that a blade insert may be moved into the handle section 10 and locked therein by shifting the slide 60 back across the transverse slide slot to the closed position shown in FIG. 24.

As seen in FIG. 29, however, it may be preferred to provide slide 60 with a slot 60a through its sloped front edge. Such a slot 60a would be offset from the longitudinal center line of the knife when the slide 60 is positioned in the closed condition shown in FIG. 24. By shifting the slide 60 a small distance, the slot 60a may be aligned with the blade insert locking edge 44 so that the blade insert could be removed from the handle section. Likewise, with the slide 60 shifted to expose the slot 60a to the blade insert recess within the handle section, a blade insert could be positioned within the handle section, and the slide 60 then shifted back to its FIG. 24 position to lock the blade insert within the handle section. With the slot 60a being off center, when the slide 60 is positioned in the closed position shown in FIG. 24, the slot 60a is covered by the handle grip 14 and is, therefore, shielded from becoming plugged with grit or the like from the knife's surroundings.

The structural and functional aspects of the handle section flanking side grips and tang spacer may be combined by being formed, as by plastic or metal molding, into one unitary element having the external and internal configurations illustrated in the drawings. Likewise, the blade section flanking side members may be formed, as by plastic or metal molding, into one unitary element having the external and internal configurations illustrated in the drawings. Moreover, the handle section and the blade section flanking side members may be formed, as by plastic or metal molding, into one unitary element so the only additional elements required for the fixed-blade knife of this invention would be the intermediate blade insert 22 and an appropriate locking means to interact with the handle to hold the blade insert within the handle section.

While the preferred embodiments of the invention has been described herein, variations in the design may be made. For example, whereas certain drawings reflect a design suitable for right-hand use, the same principles could be applied to provide a left-hand version. Various other means locking means are possible to secure the blade insert within the handle, and the three locking means illustrated in the drawings merely serve to show that the locking means may be integrally incorporated into the parts of the knife within its handle section or it may be provided as a separate element or elements mounted within or to the parts within the knife handle section. The scope of the invention, therefore, is only to be limited by the claims appended hereto.

The embodiments of the invention in which an exclusive property is claimed are defined as follows:

In the claims:

1. A knife having a handle section and a blade section, said blade section comprising a pair of opposed flanking side members, each side member having a top edge and a bottom edge and an inner surface, a blade insert locator positioned between said side members so as to provide a slot extending through said side members between the side member inner surfaces and around said blade insert locator, said slot having a top opening between the side member top edges and a bottom opening between the side member bottom edges with the top and bottom openings extending from said handle section to said blade insert locator and from said blade insert locator to outer ends of said side members, and a replaceable blade insert having a length and width configured so that said insert can be inserted through said slot between said handle section and said blade insert locator from the top opening to the bottom opening and engaged with said blade insert locator so as to retain by said blade insert locator and confined between the inner surfaces of said side members and held therebetween.

2. The knife of claim 1 wherein said blade insert includes a tang configured to extend into said handle section; and wherein said handle section is configured to receive said tang and to confine said tang within said handle section.

3. The knife of claim 1 wherein said blade insert includes a tang configured to extend into said handle section; and wherein said handle section is configured to receive said tang and to confine said tang within said handle section so that said blade insert is held in place by said insert locator and by said handle section.

4. The knife of claim 3 wherein said handle section includes locking means to secure said tang in said handle section.

5. The knife of claim 3 wherein said side members are configured to extend into and become parts of said handle section; and wherein said handle section includes a tang spacer positioned to separate said side members within said handle section so that said tang fits within said handle section between said side members.

6. The knife of claim 3 said handle section includes a locking element to secure said tang, said locking element being moveable within said handle section so as to be moveable between a first blade insert tang locking position and a second blade insert tang unlocked position.

7. A knife having a handle section and a blade section, said blade section comprising a pair of opposed flanking side member means and a replaceable blade insert means confined between said side member means and held therebetween; said side member means being joined together by blade insert locator means, said blade insert locator means being positioned between said side member means so as to provide a slot extending through said side member means and around said blade insert locator means, said slot having a top opening and a bottom opening with the top and bottom openings extending from said handle section to said blade insert locator means and from said blade insert locator means to outer ends of said side member means, and said blade insert means having a length and width configured so that said blade insert means can be inserted through said slot between said handle section and said blade insert locator means from the top opening to the bottom opening and engaged with said blade insert locator means so as to retained by said blade insert locator means, said blade insert means being configured to engage with said blade insert locator means so as to be held in place in said slot.

8. The knife of claim 7 wherein said blade insert means includes a tang configured to extend into said handle section; and wherein said handle section is configured to receive said tang and to confine said tang within said handle section so that said blade insert means is held in place by said insert locator means and by said handle section.

9. The knife of claim 8 wherein said handle section includes locking means to secure said tang in said handle section.

10. The knife of claim 8 wherein said side member means are configured to extend into and become parts of said handle section; and wherein said handle section includes a tang spacer means positioned to separate said side member means within said handle section so that said tang fits within said handle section between said side member means.

11. The knife of claim 9 wherein said side member means are configured to extend into and become parts of said handle section; and wherein said handle section includes a tang spacer means positioned to separate said side member means within said handle section so that said tang fits within said handle section between said side member means.

12. The knife of claim 7 wherein said handle section includes locking means to secure said blade insert means within said handle section.

13. The knife of claim 12 wherein said locking means comprises a locking element carried by said handle section so as to be moveable within said handle section between a first blade insert locking position and a second blade insert unlocked position.

14. A knife having a handle section and a blade section, said blade section comprising a pair of opposed flanking side members and a replaceable blade insert confined between said side members and held therebetween; said side members being joined together by blade insert locator means so as to provide a slot for said blade insert, said blade insert being configured to engage with said blade insert locator means so as to be held in place in said slot; said handle section including locking means to secure said blade insert within said handle section, said locking means comprising a locking element carried by said handle section so as to be moveable within said handle section between a first blade insert locking position and a second position blade insert unlocked position, said locking element comprising a slide fitted into a transverse slide notch within said handle section, said slide being moveable transversely of said handle section between said first and second positions.

* * * * *